US007036413B2

(12) United States Patent
Hartmann et al.

(10) Patent No.: US 7,036,413 B2
(45) Date of Patent: May 2, 2006

(54) DEVICE FOR THE TRANSVERSE CUTTING OF AT LEAST ONE WEB IN A FOLDING APPARATUS

(75) Inventors: Manfred Wolfgang Hartmann, Elfershausen (DE); Horst Bernhard Michalik, Höchberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 69 days.

(21) Appl. No.: 10/240,761

(22) PCT Filed: Apr. 6, 2001

(86) PCT No.: PCT/DE01/01346

§ 371 (c)(1),
(2), (4) Date: Oct. 15, 2002

(87) PCT Pub. No.: WO01/78953

PCT Pub. Date: Oct. 25, 2001

(65) Prior Publication Data

US 2003/0126966 A1 Jul. 10, 2003

(30) Foreign Application Priority Data

Apr. 15, 2000 (DE) ..... 100 18 7722

(51) Int. Cl.
*B26D 1/62* (2006.01)

(52) U.S. Cl. ..... 83/154; 83/305; 493/429

(58) Field of Classification Search ..... 83/304, 83/305, 154; 270/42, 47, 48, 49, 50; 493/428–432
See application file for complete search history.

(56) References Cited

U.S. PATENT DOCUMENTS

| | | | | |
|---|---|---|---|---|
| 1,826,601 | A * | 10/1931 | Crafts | 270/42 |
| 1,969,480 | A * | 8/1934 | Shipley | 270/50 |
| 1,970,931 | A * | 8/1934 | Crafts | 270/6 |
| 1,986,212 | A | 1/1935 | Mahon | |
| 2,026,443 | A * | 12/1935 | Tomlin | 493/360 |
| 2,031,780 | A * | 2/1936 | Lamatsch | 493/360 |
| 2,405,204 | A * | 8/1946 | Goodrich | 83/337 |
| 3,758,102 | A * | 9/1973 | Munn et al. | 493/342 |
| 4,490,132 | A * | 12/1984 | Ogura et al. | 493/424 |
| 4,635,915 | A * | 1/1987 | Sato | 270/49 |
| 4,685,318 | A * | 8/1987 | Ueda et al. | 72/185 |
| 4,892,036 | A * | 1/1990 | Lange | 101/240 |
| 5,367,936 | A | 11/1994 | Held et al. | |
| 5,465,641 | A | 11/1995 | Herd | |
| 5,503,071 | A * | 4/1996 | Hillebrand et al. | 101/409 |
| 5,592,864 | A * | 1/1997 | Breton | 83/154 |
| 6,128,988 | A * | 10/2000 | Hillebrand et al. | 83/115 |

FOREIGN PATENT DOCUMENTS

| | | |
|---|---|---|
| DE | 42 11 187 A1 | 10/1993 |
| EP | 0 559 077 A1 | 9/1993 |

* cited by examiner

*Primary Examiner*—Kenneth E. Peterson
(74) *Attorney, Agent, or Firm*—Jones Tullar & Cooper, PC

(57) ABSTRACT

A printed, endless web is transversely cut by the cooperation of a cutting blade cylinder and a sheet gripping cylinder that also carries cutting blocks. If the web that is to be cut, is noted as having a defect, for example in the printing applied to it, the cutting blades can be withdrawn into the cutting blade cylinder and the deflective web can be diverted away from the folding apparatus.

4 Claims, 8 Drawing Sheets

DEVICE FOR THE TRANSVERSE CUTTING OF AT LEAST ONE WEB IN A FOLDING APPARATUS

FIELD OF THE INVENTION

The present invention is directed to a device for the transverse cutting of at least one web in a folding apparatus by use of a cutting blade cylinder. The cutting blade cylinder has at least one cutting blade and this at least one cutting blade can be retracted inside the circumference of the cutting blade cylinder.

BACKGROUND OF THE INVENTION

EP 0 559 077 A1 and DE 42 11 187 A1 describe cutting cylinders whose cutting blades can be retracted.

SUMMARY OF THE INVENTION

The object of the present invention is to provide a device for the transverse cutting of at least one web in a folding apparatus by use of a cutting blade cylinder.

This object is attained according to the present invention by providing the cutting blade cylinder with at least one cutting blade that can be retracted inside the circumference of the cutting blade cylinder. The cutting blade cylinder is disposed opposite to a cylinder with point needles. Both the cutting blade or blades and the point needles can be retracted in the vicinity of a nip between the two cylinders. The retractable cutting blade or blades are coupled to rollers that roll on a cam. The cam can be moved to deploy and to retract the cutting blade in the circumferential direction of the cutting blade cylinder.

The advantages that can be achieved with the present invention are comprised particularly in that the removal of uncut webs or of webs in the form of cut ribbon sections or signatures is facilitated, which removals are easier to handle than the removal of wound webs. In addition, the signatures are supplied to an extraction system for disposal, and can be sorted according to whether they are printed or unprinted. It is also possible to supply an uncut paper web ribbon to the extraction system. Consequently, for example, a web infeed all the way into the folding apparatus can be carried out automatically without the paper web speed having to be reduced. A manual winding-on of a paper web before the folding apparatus entry can be eliminated.

Other advantages which can be achieved by the present invention are that when feeding paper webs into a folding apparatus, individual paper webs, before their entry into a folding cylinder group, no longer have to be manually disposed of, but instead, the paper webs are conveyed away cut into signatures. This occurs until all the paper webs of the paper web ribbon are together at the entry to the folding apparatus and can subsequently be transversely folded all at once.

Together with a paper diversion apparatus, the device for the extraction of signatures of the present invention can also be used in the event of malfunctions of the folding system in the cylinder folding group or of the delivery belt. The placement of a known paper ribbon rejection system, before, in the direction of web travel, the entry of the web or signatures into the cylinder folding group can be eliminated.

BRIEF DESCRIPTION OF THE DRAWINGS

Several preferred embodiments of the present invention are shown in the drawings and will be explained in detail below.

DESCRIPTION OF PREFERRED EMBODIMENTS

Figure 1:
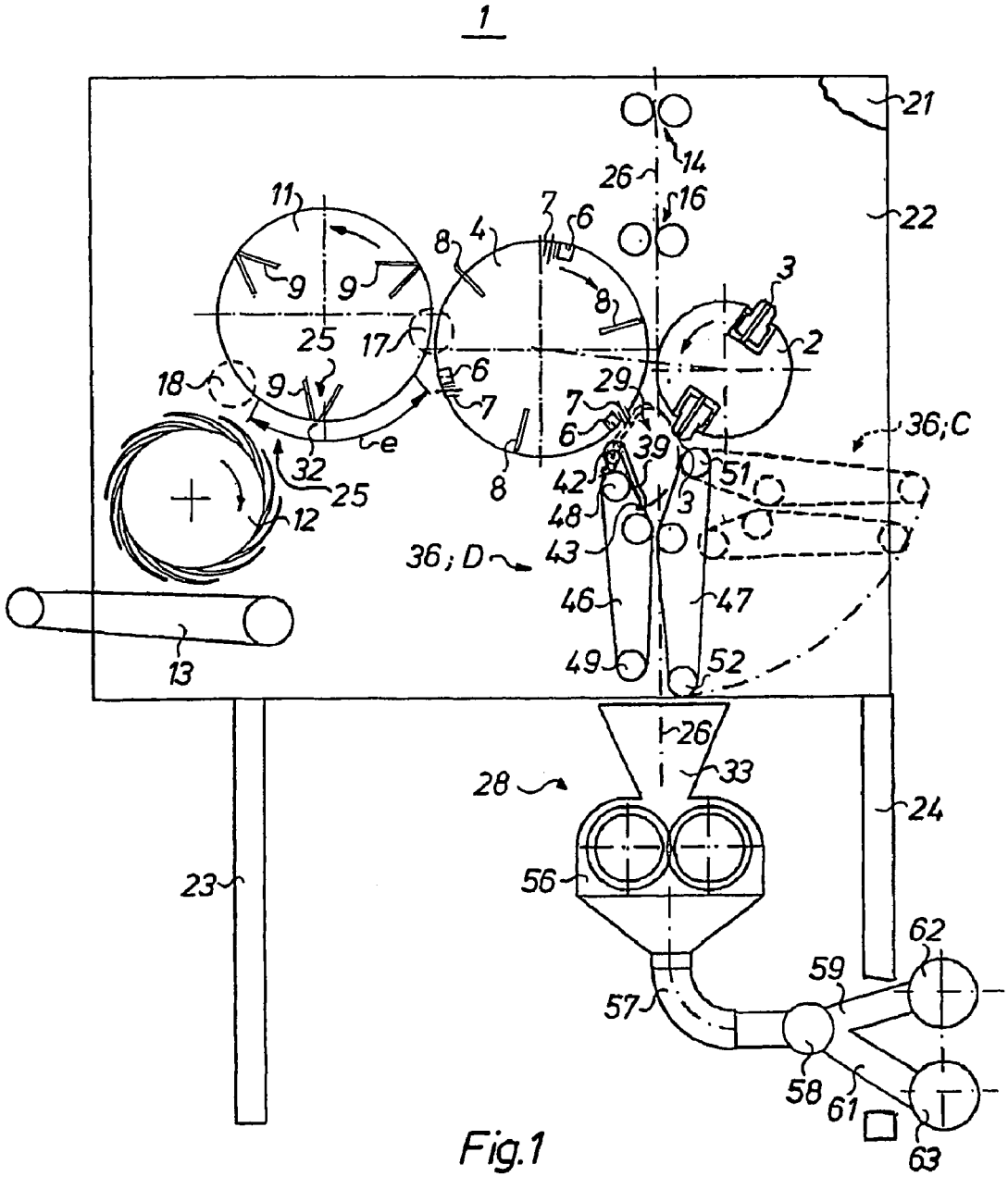
FIG. 1 schematically depicts a cross section through a cylinder group of a folding apparatus provided with a device for the extraction of signatures from the folding apparatus in accordance with the present invention.

Referring initially to FIG. 1, a cylinder folding group of a folding apparatus 1 of a web-fed rotary printing press is comprised, for example, of a two-field cutting blade cylinder 2, which has cutting blades 3 and which cooperates with a three-field transport cylinder or a countercutting strip- and collecting cylinder 4. The collecting cylinder 4 has counter cutting strips 6 that cooperate with the blades 3, sheet gripping mechanisms or holding elements, such as, for example, controlled point systems 7 with point needles 10, and folding blades 8.

The collecting cylinder 4 cooperates with a three-field folding jaw cylinder 11 that has controlled folding jaw systems 9.

The folding jaw cylinder 11 is followed, in the direction of product travel, by a delivery fan 12 and by a delivery belt 13. The folding apparatus 1 can also be configured differently. For example, the counter cutting strip- and collecting cylinder 4 can also be embodied as a five-field or seven-field cylinder with a corresponding folding jaw cylinder 11 associated with it.

The transverse cutting device, which is comprised of the cutting blade cylinder 2 and of the transport cylinder 4, such as the collecting cylinder 4, is preceded by two generally conventional draw roller pairs 14; 16. In the vicinity of their circumferences, the collecting cylinder 4 and the folding jaw cylinder 11 each have paper guide devices, which are not specifically shown, and which are comprised, for example, of guide rails that are spaced apart from each other in the production direction.

The cylinder folding group 2; 4; 11 of the folding apparatus 1, and the delivery fan 12 are supported in side frames 21, 22. The side frames 21; 22 can be placed on machine frames 23; 24 that are disposed underneath them, all as seen in FIG. 1.

Figure 2:
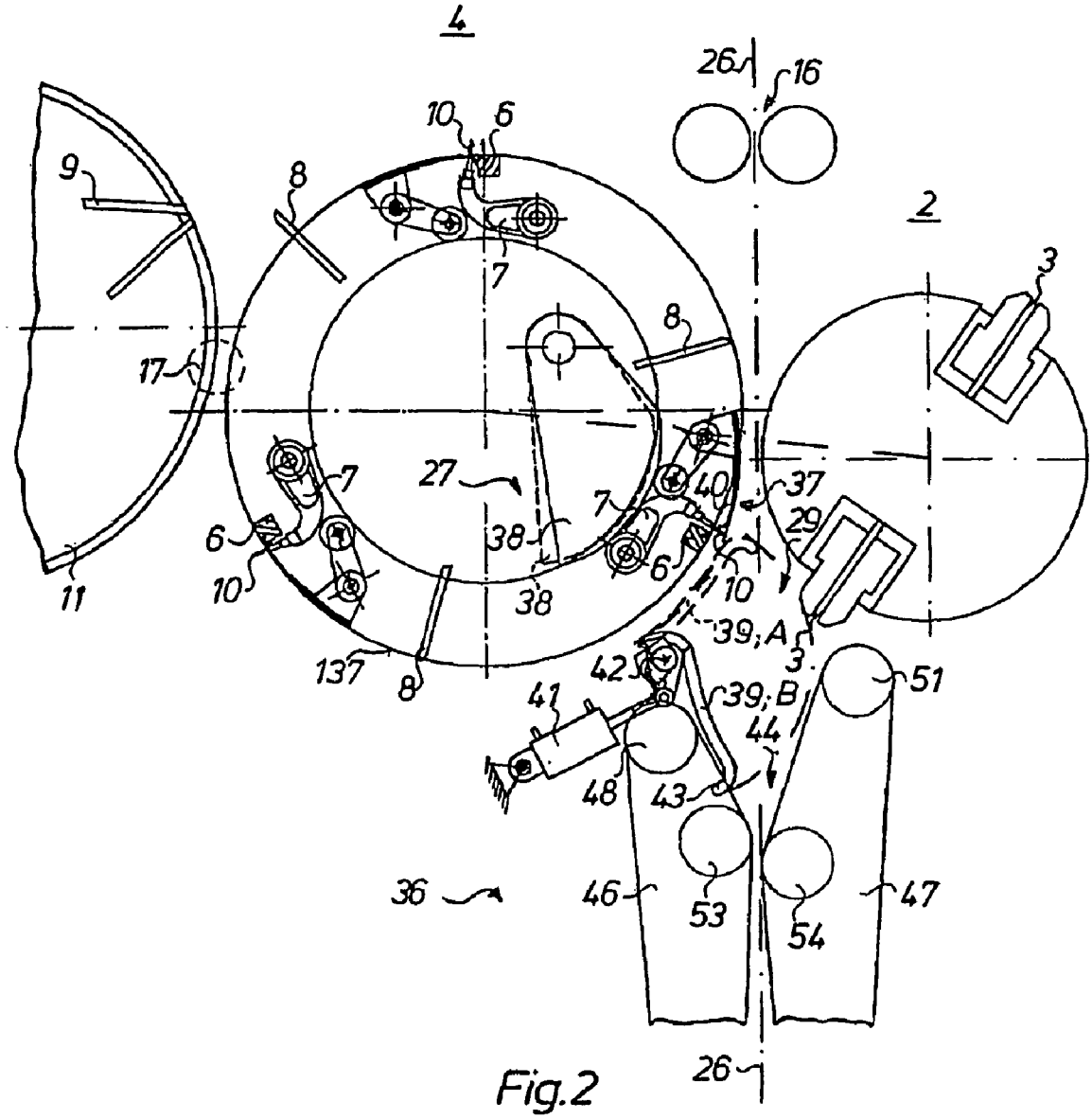
FIG. 2 is an enlarged depiction of the delivery device, guide, and entry into the grasping and transporting apparatus in accordance with a first preferred embodiment of the present invention.

A first preferred embodiment of a device for handling and, in particular, for diverting a web or a material web, for example a paper web or a paper web ribbon 26 which is comprised of several paper webs 26, is positioned before or after a transfer point 17, 18 for signatures 19, and has a switchable delivery device 27 or 25 that is useable to direct the web or signatures to a disposal apparatus 28, all as seen in FIGS. 1 and 2. The transfer point 17 for signatures 19 is disposed in a nip between cylinder 4 and cylinder 11 and the transfer point 18 is disposed between the cylinder 11 and the delivery fan 12.

Figure 3:
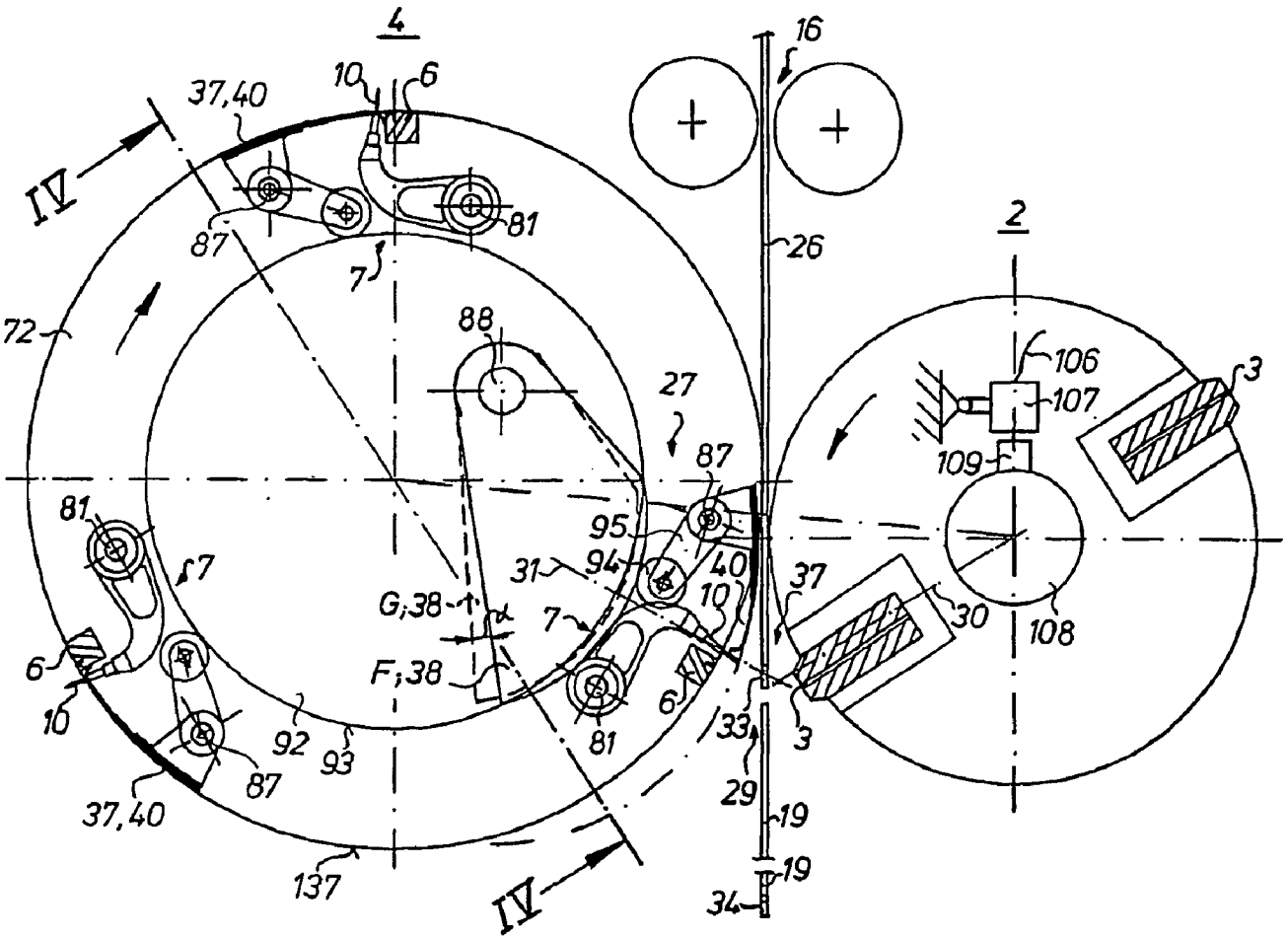
FIG. 3 is a detailed depiction of a drive mechanism of the delivery device.

The switchable delivery device 27 is shown in FIGS. 2 and 3 and can be disposed on the circumference of the cylinder 2 or of the cylinder 4 and the delivery device 25 can be disposed on the cylinder 11. Both of the delivery devices 27 and 25 can be actuated by suitable control devices.

The delivery device 27 cannot function in the cutting region of the cylinder pair 2; 4 or in the vicinity of the transfer points 17; 18. The delivery device 27 is preferably actuated in the vicinity of the exit nip 29 of the cylinder pair 2; 4; i.e. before the transfer point 17 at a release point 31 or after the transfer point 18 in a region "e" at a release point 32. The delivery device 25 in this case is comprised of a folding jaw system 9 controlled in this region "e". At the release point 31 of the cylinder 4, as seen in FIG. 3 or 32 of cylinder 11, as seen in FIG. 1, the respective holding devices 7 and 9 are inoperative so that the beginning 33 of the paper web ribbon 26 or the beginning 34 of the signatures 19 is conveyed to a switchable ribbon- or signature-grasping- and transporting apparatus 36, which is shown more clearly in FIGS. 1 and 2.

Figure 4:
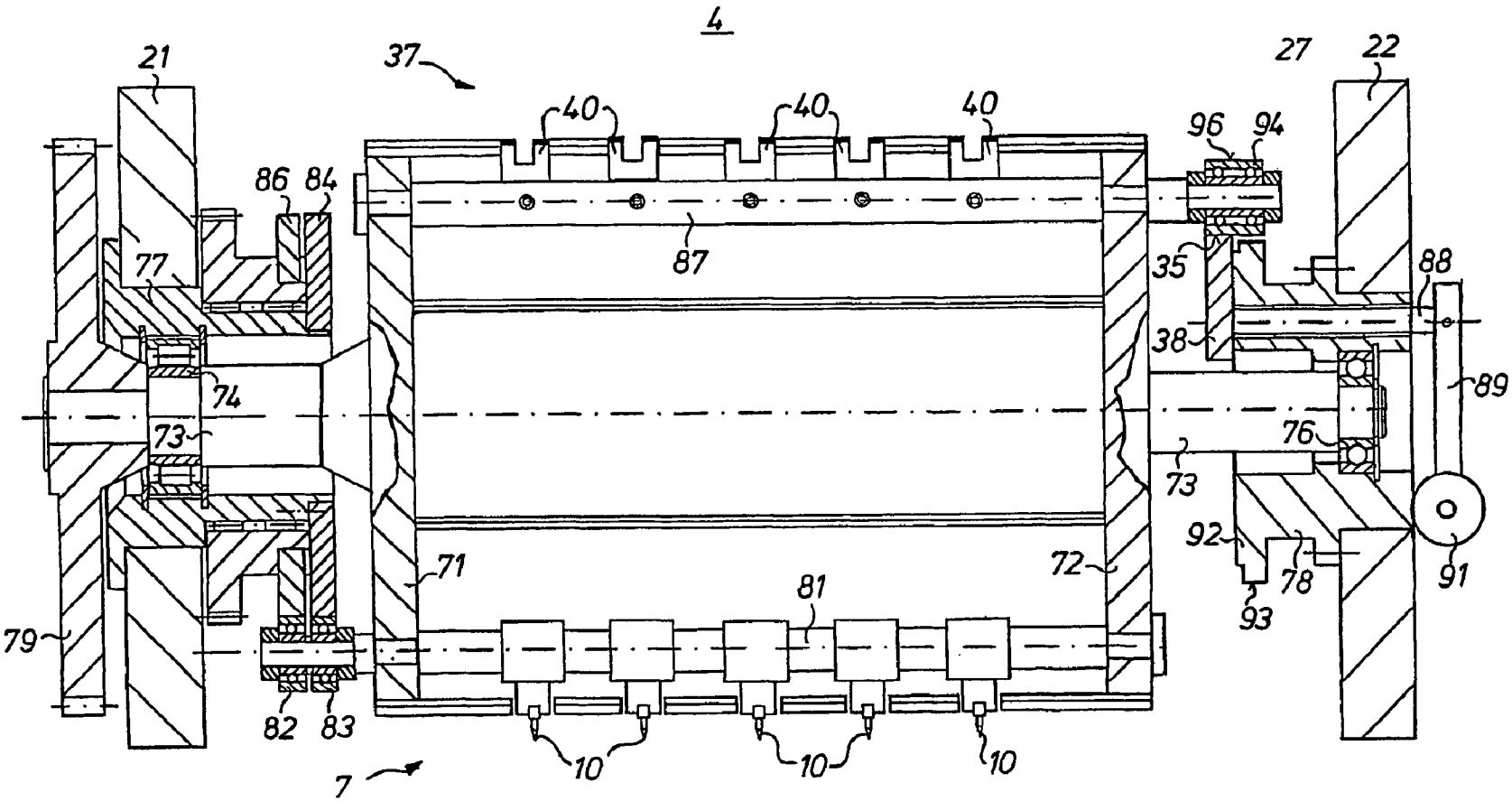
FIG. 4 is a cross-sectional view taken along the line IV—IV of FIG. 3.

In the case of the cylinder 4, as seen most clearly in FIGS. 3 and 4, the holding devices are comprised of point needle systems 7. The delivery device 27 of the cylinder 4 is embodied as a stripping device 37 for the needles of the point needle systems 7. In terms of the production rotation direction of the cylinder 4, the stripping devices 37 are respectively disposed after the point needle systems 7 and are comprised of retracting devices 40, which encompass the point needles 10 in a fork-shaped, or partial, fashion. The retracting devices 40 can also completely encompass the point needles 10, such as, for example, if the retracting devices 40 have bores through which the point needles 10 protrude.

These stripping devices 37 are connected to a pivotable cam segment 38, which is affixed to the side frames 21, 22 and which can be pivoted into and out of position. In the event of an extraction, the signatures 19 shown in FIG. 3, i.e. the paper web 26 transversely cut into pieces, are shunted downward from the point needles 10 of the point systems 7 by operation of the retracting devices 40 of the stripping device 37 and are conveyed to the disposal apparatus 28, as shown in Fig.

Between the stripping device 27 and the ribbon, or signature-grasping, and transporting apparatus 36, a guide 39 or a switchable shunt is advantageously disposed, spaced apart, at the circumference of the collecting cylinder 4 and can be pivoted into a rest position A, depicted with dashed lines, or into a working position B, as seen most clearly in FIGS. 1 and 2.

The guide 39 is comprised, for example, of a part of the paper guide device and is disposed close to the exit nip 29 of the transverse cutting cylinder group 2; 4. The guide 39 is actuated, for example, by the operation of pneumatic working cylinders 41, which are shown in FIG. 2 and can be pivoted around a pivot axis 42 between the two above-mentioned positions A; B.

In the working position B of the guide or switchable shunt, the ends 43 of the guide 39 which are remote from the pivot axis, cooperate with a wedge-shaped, tapering entry nip 44 defined between two concurrently operating endless belt systems 46; 47 of the ribbon or signature-grasping and transporting apparatus 36 again as seen most clearly in FIGS. 1 and 2. The belt systems 46; 47 are respectively each guided over deflecting rollers 48; 49; or 51; 52 and over guide rollers 53; 54. The deflecting rollers 49; 52 are driven, for example, by drive motors. The two belt systems 46; 47 are disposed, for example, in a frame that is not shown. This frame can be pivoted by a drive mechanism, that is not shown, such as pneumatic working cylinders, from a horizontal rest position C, depicted with dashed lines, into a vertical working position D around a pivot axle 42 that is affixed to the side frames, as seen most clearly in FIG. 1.

As will be discussed below, the point needle systems 7 passing through the exit nip 29 of the transverse cutting cylinder group 2; 4 can also be temporarily retracted as needed.

It is also possible to use other grasping systems, e.g. gripper systems, in lieu of the point needle systems 7.

It is also possible to dispose the above-mentioned grasping systems 7 on the circumference of the cutting blade cylinder 2 and to suspend their operation in the event of an extraction in the vicinity of a release point 30.

Signatures 19 are provided as transversely cut and possibly previously longitudinally folded sections of a paper web ribbon 26 or a paper web.

The disposal apparatus 28 is depicted in FIG. 1 and is comprised of a generally known chopping mechanism 56. The signatures 19, which are chopped or shredded in the disposal apparatus are supplied by an air suction-carrying conduit 57, and possibly by a conduit shunt 58, to another conduit 59 or 61, either to a delivery point 62 for white or unprinted paper remnants or to a delivery point 63 for printed paper remnants.

The machine control station can act on the conduit shunt 58 by the use of a signal to select its position, e.g. for "pressure off" or "pressure on", Instead of situating a chopping mechanism 56 after it, the output of the ribbon, or signature-grasping and transporting apparatus 36 can also be associated with vertically situated conduits and subsequent conveyor belts for transporting the signatures 19 to one or alternatively to several collecting receptacles. This can take place for both unprinted and printed signatures.

A method for handling a paper web beginning or a signature 19, using the device in accordance with the present invention takes place as follows: If, for example, new paper webs 26 are being fed into a web-fed rotary printing press, then the paper webs 26 arrive one after the other and possibly individually before the entry to the transverse cutting cylinder group 2; 4 of the folding apparatus 1. The beginnings or leading ends 33 of the paper webs 26 are continuously supplied to the transverse cutting cylinder group 2; 4 that is provided with grasping mechanisms 7. By operation of the guide 39 or shunt, which is disposed in the working position B, and with the aid of the retraction device 40 of the stripping device 37, the leading ends 33 of the paper web 26, are supplied to the belt systems 46; 47, which are disposed in the working position D. In other words, the paper web leading ends 33 are diverted from the otherwise usual production process. Generally speaking, first the beginning 33 of the paper web ribbon 26 is gripped or pinned by the grasping means, e.g. by the point needle systems 7, of the cylinder 4 and is transported. For example, before the transfer point 17 of the signatures 19 to the folding jaw cylinder 11 and in the exit nip 29 of the transverse cutting cylinder group 2; 4, the beginning 33 of the paper web or of the paper web ribbon 26 is released by the point needle systems 7, e.g. by use of the delivery device 27, and is then supplied to the belt systems 46; 47 of the disposal apparatus 28.

If the release point 31 lies outside the exit nip 29 of the transverse cutting cylinder group 2; 4, and at least in the vicinity of the transfer point 17, then the signatures 19 are diverted at that point.

If the machine control station sends a signal which instructs the system to discontinue web or signature extraction, then the delivery device 27 executes its function by changing the position of the cam segment 38 and the shunt or guide 39. The ribbon or signature-grasping- and transporting apparatus 36 then assumes its rest position C, as depicted in dashed lines in FIG. 1 and the belt systems 46; 47 are pivoted into their rest position C. The signatures 19 then travel in the usual manner through the folding apparatus 1.

If malfunctions occur during the course of production, then the devices 27; 36 can be made operational again. The same is true when new paper webs are fed in.

The collecting cylinder 4, as seen in FIG. 4, has end plates 71; 72 at its ends, which end plates 71; 72 are affixed to a shaft 73. The shaft 73 is supported in a freely rotating fashion at both ends by bearings 74; 76 and by bearing bushings 77; 78 affixed to the side frames. Shaft 73 can be driven by a gear 79, as seen in FIG. 4. The end plates 71; 72 support three circumferentially spaced point shafts 81, which shafts 81 support the respective point needle systems 7 with the point needles 10. Alternatively, five or seven point shafts 81 can also be provided. Each point shaft 81 is connected by a lever arm, which is not specifically shown, and by cam rollers 82; 83 to a known cam 84 for the point needle systems 7 affixed to the side frames, and to a cam 86, a so-called covering disk, which is rotatably supported on the bearing bushing 77 and which can be driven by a transmission.

Preceding the point needle systems 7, in the direction of the rotation of the cylinder 4, stripping devices 37 that encompass the point needles 10 in a fork-shaped fashion, in accordance with the present invention, are disposed on a hollow shaft 87, which is affixed to the end plates 71; 72 and which contains a torsion spring. The segment-shaped cam segment 38, as seen in FIG. 3, which is affixed to the side frames and which can be pivoted by an angular amount a from a rest position G to a working position F, is disposed at the release point 31 provided for the retraction, e.g. in the exit nip 29 of the transverse cutting cylinder group 2; 4. By use of a shaft 88, which is guided by the bearing bushing 78, and extending in a direction axially parallel to the shaft 73, and by use of a lever arm 89, the cam segment 38 is connected to a hydraulically operated working cylinder 91 that is affixed to the side frames, all as seen in FIG. 4.

At its end adjacent the end plate 72, the bearing bushing 78 has a cylindrical cam 92 disposed coaxial to the shaft 73, with a circular control surface 93 on its circumference. A cam roller 94, with a double-width running surface 96, revolves against this control surface 93. The term "double-width" means that the running surface 96 of the cam roller 94 is connected both to the control surface 93 of the cam 92 and to the control surface 35 of the cam segment 38. The cam roller 94 is connected to the hollow shaft 87 of a lever arm 95.

Figure 5:
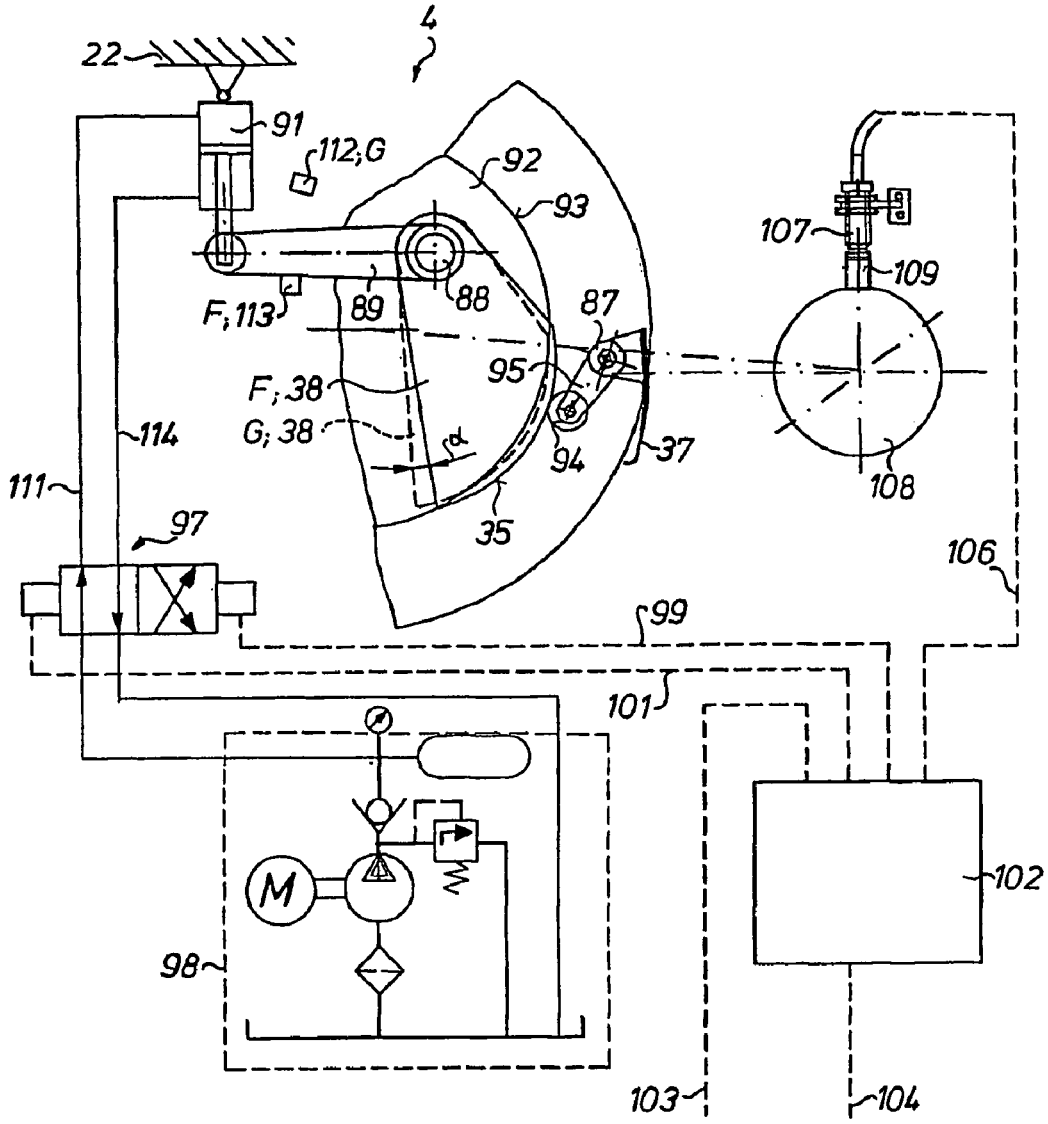
FIG. 5 shows a partial cutaway detail of the drive mechanism and of the control unit of a stripping device according to FIG. 2 or 3.

The working cylinder 91 is embodied to be double-acting and is connected of a control valve 97 to a pressure supply station 98, as depicted schematically in FIG. 5. The pressure supply station 98 includes, for example, a hydraulic pump, a pressure regulator, a check valve, a hydraulic reservoir, and a measuring device. The control valve 97 is, in turn, connected by control lines 99; 101 to a control unit 102, which is, in turn, connected by lines 103; 104 to a computer or control station and is also connected by of a line 106 to a sensor 107 that is affixed to the side frame. The sensor 107 detects the respective position of the cutting blade 3 by operation of a cam 109 resting against the shaft 108 of the cylinder 2.

The computer or control station sends signals to the control unit 102 by the lines 103; 104. Consequently, the working cylinder 91 is supplied with hydraulic fluid by the control valve 97 and a line 111 so that the cam segment 38 is moved from the rest position G to the working position F, as seen in FIG. 5. The deflection of the lever arm 89 and consequently of the cam segment 38 is limited by stops 112:113 affixed to the side frames, also as depicted schematically in FIG. 5.

Through a rotation of the cam segment 38 by an angular amount $\alpha$, of, for example, 5°, the control surface 35 of the cam segment 38 slides against the control surface 93 of the cam 92, as shown in FIG. 5. By use of the double-width cam roller 94, the lever arm 95 is then lifted as it rolls over the control surface 35 and in so doing, the retracting device 40 of the stripping device 37 is also lifted up. As a result, the beginning 33 of the paper web ribbon 26 is lifted up by the point needles 10 of the point needle systems 7, is diverted from the cylinder 4, and is supplied to the disposal apparatus 28.

In the process of rolling against the control surface 93, the double-width cam roller 94 already has a particular speed, which is only increased by a negligible amount as roller 94 travels over the control surface 35 of the cam segment 38.

If a signal for good signatures 19 is sent from the computer or from the control station via the line 103; 104 to the control unit 102 and a signal of the sensor 107 conforms with this signal, then the working cylinder 91 is supplied with hydraulic fluid via the control valve 97 and a line 114, as a result of which the cam segment 38 is moved into the rest position G.

This assures that only complete products, i.e. signatures 19, are transferred to the cylinders of the folding apparatus 1 and the additional processing apparatuses.

In accordance with a second preferred embodiment, a device for handling, extracting, or redirecting of signatures 19 or a beginning 33 of a paper web 26 or a paper web ribbon is comprised, for example, of releasable grasping mechanisms, e.g. of retractable point needle systems 7. The point needle systems 7 are disposed on the collecting cylinder 117 of the first cylinder pair 2; 117, as seen in FIG. 6, and are disposed so that they can be retracted inside the circumference 137 of the collecting cylinder 117, at least in the vicinity of an exit nip 118, by operation of a point needle system control mechanism 81, 119, 121, 122, 134, 140.

Figure 6:
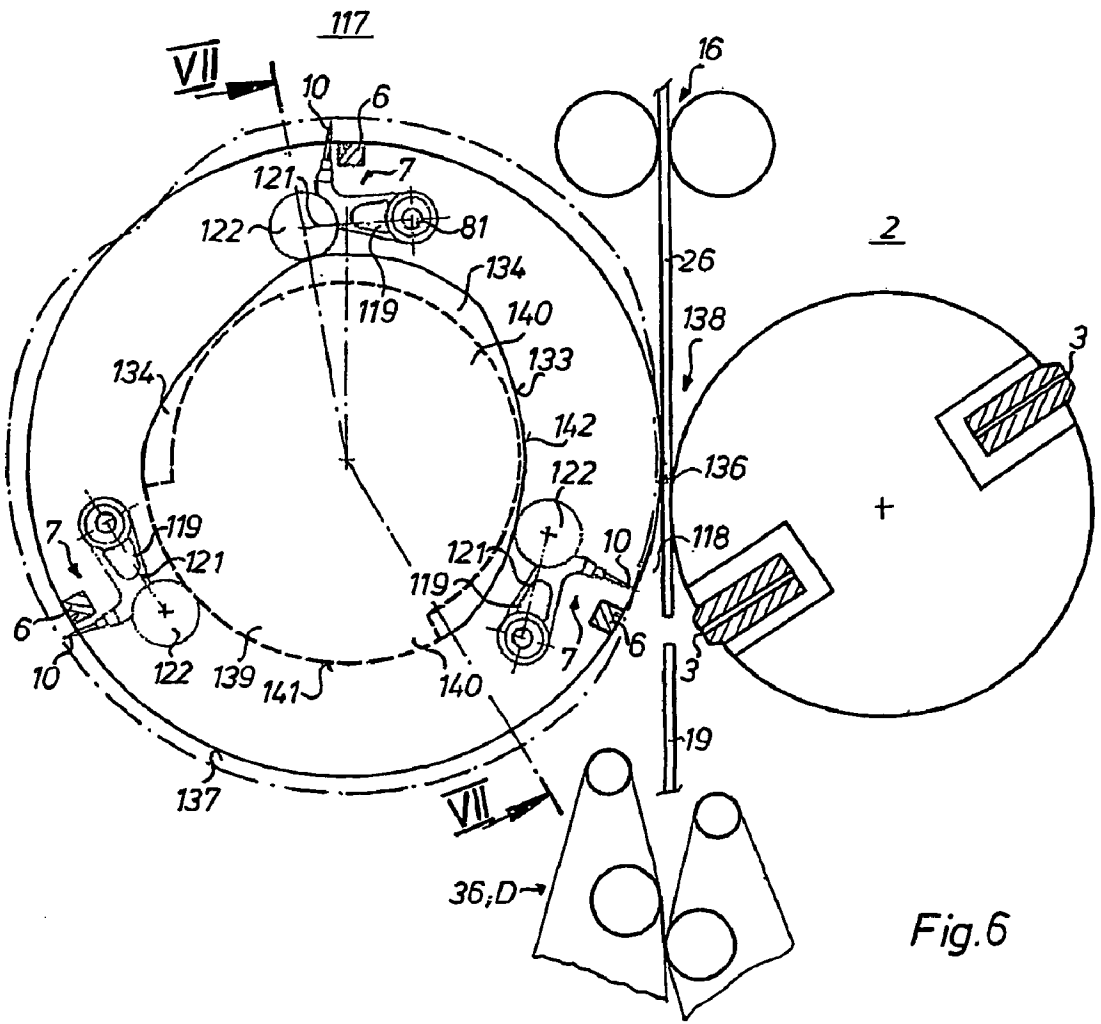
FIG. 6 is an enlarged depiction of a cutting cylinder and of a point and counter-cutting strip cylinder in accordance with a second preferred embodiment of a delivery device for the extraction of a signature in accordance with the present invention.

As a result, the signatures 19 can be extracted from the usual production process after they pass through the exit nip 118 that is disposed between the cutting blades cylinder 2 and the collecting cylinder 117 shown in FIG. 6. To that end, the cutting blade cylinder 2 has, for example, two cutting blades 3 on its circumference, as described above.

The point needles 10 are held in point needles holders 119 which are disposed on a point shaft 81. A roller lever 121 is affixed to each point shaft 81 and supports a double-width cam roller 122 at its end, again as shown in FIG. 6.

Figure 7:
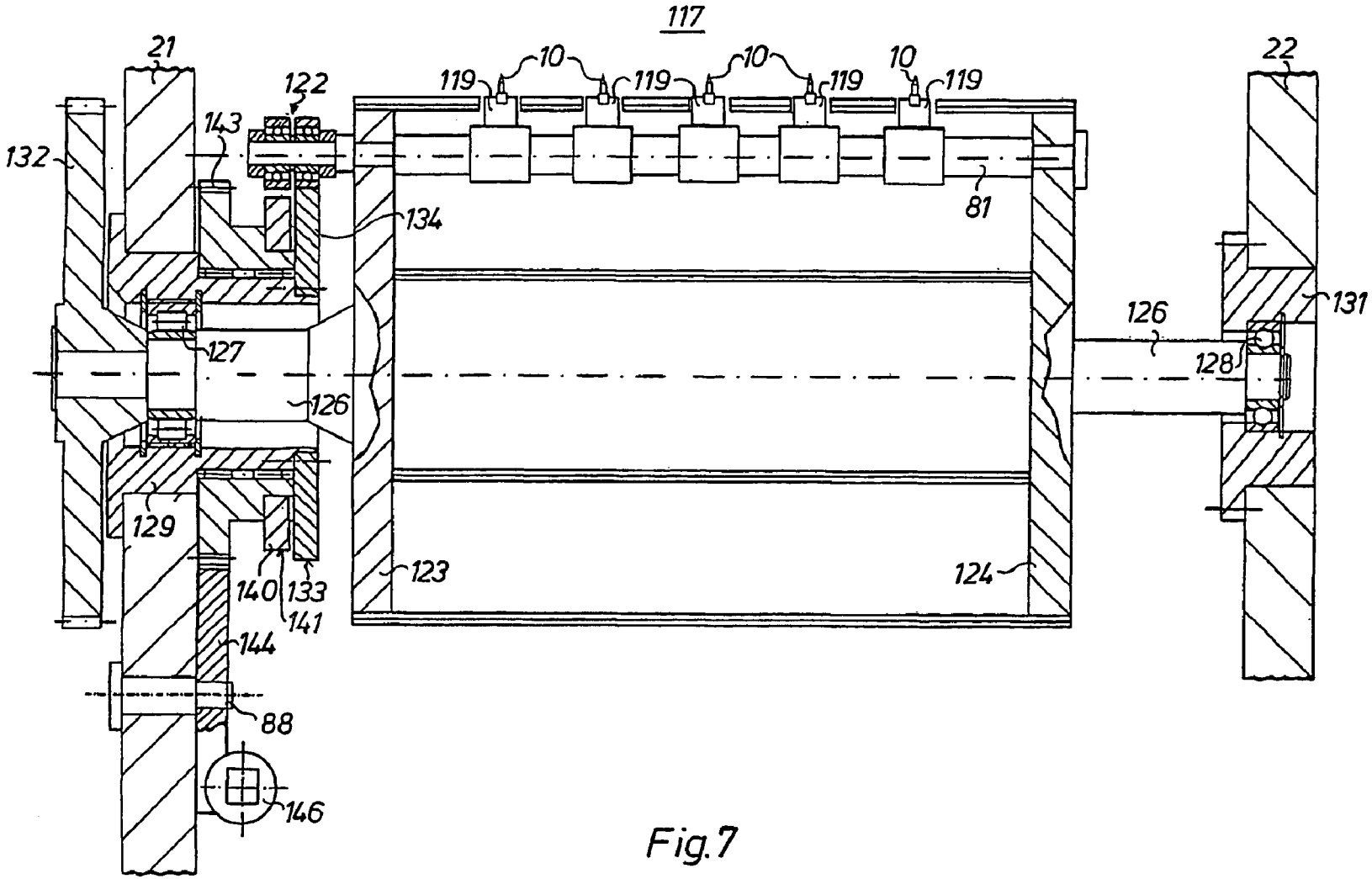
FIG. 7 is a cross-section taken along the line VII—VII in FIG. 6.

Two end plates 123; 124 support the collecting cylinder 117 on a shaft 126, as shown in FIG. 7. The shaft 126 is supported in a freely rotating fashion at both ends by bearings 127; 128 and by bearing bushings 129; 131 which are affixed to the side frames. Shaft 126 can be driven by a gear 132, as may also be seen in FIG. 7.

On one side of collecting cylinder 117, a portion of the double wide cam roller 122 travels on a control surface 133 of the cam 134 affixed to the side frame. The control surface 133 is embodied, i.e. is flattened, so that, in the vicinity of a nip 136 between the cutting blade cylinder 2 and the collecting cylinder 117, the tips of the point needles 10 can be retracted inside the circumference 137 of the collecting cylinder 117, as is depicted in FIG. 6.

In the vicinity of the nip 136 is understood to mean in the vicinity of an entry nip 138 and of an exit nip 118 of the cutting blade cylinder 2 and the collecting cylinder 117.

Consequently, the signatures 19 cut by operation of the cutting blade 3 and the counter cutting strip 6 can be supplied in the event of defective signatures to a ribbon or signature-grasping and transporting apparatus 36 and a disposal apparatus 28. In other words, these signatures can be separated out.

If the point needles 10 need to again protrude out from the circumference 137 of the collecting cylinder 117 in the vicinity of the nip 136 in order to be able to transport the signatures 19 further, then the drivable covering disk 140 shown in FIG. 6 is rotated approximately 90° counterclockwise, so that cover disk 140 then covers a flattened region 142 of the control surface 133 with a raised area 139 in its control surface 141. The covering disk 140 is affixed to the rotatable bearing bushing 129, which bushing 129 also supports a toothed ring 143, as seen in FIG. 7. A rotation of the covering disk 140 is produced by use of a gear segment 144, which is pivotable affixed to the side frame and which can be selectively moved into one of two positions by utilization of a working cylinder 146.

In lieu of the point needle systems 7, it is also possible to use other grasping systems, for example other gripper systems.

Figure 8:
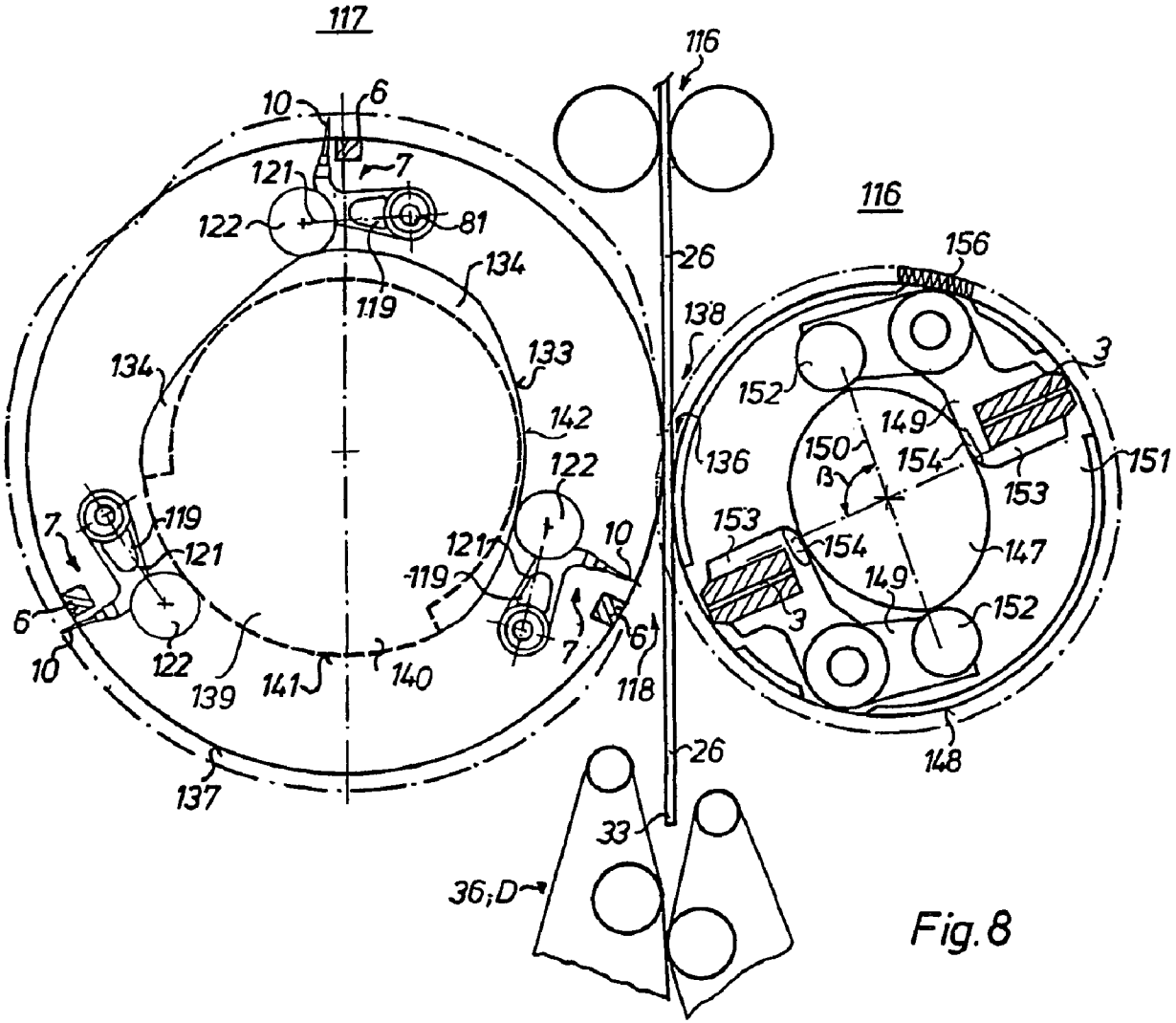
FIG. 8 shows an enlarged depiction of a cutting cylinder and a point- and counter cutting strip cylinder in accordance with a third preferred embodiment of a device for the extraction of a paper web in accordance with the present invention.

In order to support the extraction effect of a beginning 33 of a web 26, the cutting blades 3 on the cutting blade cylinder 2 or the cutting blade cylinder 116, shown in FIG. 8, can be retracted inside the circumference 148 of the cutting blade cylinder 116, at least in the vicinity of the nip 136. In the depiction of FIG. 8, both the point needles 10 of the cylinder 117 and the cutting blades 3 of the cutting blade cylinder 116 are retracted in the vicinity of the nip 136.

The beginning 33 of the web 26 and thereafter, consequently, the entire web 26 can be supplied to the ribbon or signature-grasping and transporting apparatus 36 and to the disposal apparatus 28.

A control body 147, which is connected to the side frame 21 or 22, which is, for example, oval in cross section, and which can rotate on the shaft of the cutting blade cylinder 116, is provided in order to retract the cutting blades 3 in the vicinity of the nip 136. This control body 147 is seen in FIG. 8 and can be rotated by mechanisms that are not shown, for example by working cylinders, through an angle β of 90°, in relation to the outer cutting blade cylinder 116 so that the vertical axis 150 of the cross-sectionally oval control body 147 no longer points in the direction of the cam rollers 152 as shown in FIG. 8, but points in the direction of the cutting blades 3. Depending on the position of the control body 147, the cutting blades 3 are either inside the circumference 148 of the cutting blade cylinder 116, as shown in FIG. 8 or are positioned in the normal, operational position that is not shown, i.e. outside the circumference 148, when they are in the vicinity of the nip 136.

The cutting blades 3 of cutting blade cylinder are each supported at both ends by two-armed elbow levers 149 that are supported in the end plates 151. There can be several elbow levers 149 for each cutting blade 3.

A first end of the elbow lever 149 supports a cam roller 152 and a second end of the elbow lever 149 supports the cutting blade 3 in a cutting blade holder 153. The side of the cutting blade holder 153, that is oriented away from the cutting edge of the cutting blade 3, has a friction reducing antifriction layer 154, with which the cutting blade 153 is supported on the surface of the control body 137.

In a suitable manner, the cutting blade cylinder 116 has brushes 156 on its casing surface or circumference 148, which are used to press the paper web ribbon 26 against the counter cutter strip and collecting cylinder 117.

While preferred embodiments of a device for the transverse cutting of at least one web in a folding apparatus, in accordance with the present invention, have been set forth fully and completely hereinabove, it will be apparent to one of skill in the art that various changes in, for example, the type of printing press used to print the web, the overall size of the press, and the like could be made without departing from the true spirit and scope of the present invention which is accordingly to be limited only by the appended claims.

What is claimed is:

1. A device for the selective extraction of at least one web in a folding apparatus comprising:

a cutting blade cylinder;

a collecting cylinder opposite to said cutting blade cylinder and cooperating with said cutting blade cylinder at a point of cylinder cooperation to define a cylinder nip at said point of cylinder cooperation;

at least one cutting blade carried by said cutting blade cylinder and being useable with said collecting cylinder to transversely cut the web into signatures at said cylinder nip;

an exit nip for said collecting cylinder, said exit nip being located after, in a direction of rotation of said collecting cylinder, said cylinder nip and before a transfer point for signatures cut from the web by said at least one cutting blade cylinder and said collecting cylinder;

means selectively retracting said at least one cutting blade inside a circumferential surface of said cutting blade cylinder at said cylinder nip during cessation of cutting of the web into signatures;

point needles on said collecting cylinder, said point needles being selectively engageable with a leading end of the web at said cylinder nip; and a point needle control system for selectively retracting said point needles out of engagement with the leading end of the web and inside a circumferential surface of said collecting cylinder before said cylinder nip, and for retaining said point needles retracted inside said collecting cylinder at said collecting cylinder nip and at said cylinder exit nip, to release a leading end of at least one web from said collecting cylinder at said cylinder exit nip after said cylinder nip defined by said cutting blade cylinder and said collecting cylinder and before said transfer point, said point needles retraction at said cylinder nip occurring at the same time as the retraction of the at least one blade such that lengths of web are extracted from the folding apparatus prior to being folded.

2. The device of claim 1 including a cutting blade holder, said at least one cutting blade being disposed in said cutting blade holder and wherein said cutting blade cylinder includes a shaft and further including a cam supported on said shaft and extending coaxial with said shaft, said cam being rotatable on said shaft and being said means to selectively retract said at least one cutting blade inside of said circumferential surface of said cutting blade cylinder at said cylinder nip.

3. The device of claim 2 further including side frames of the folding apparatus and an adjustable control body secured to said side frames, said cutting blade holder being in frictional contact with said adjustable control body.

4. The device of claim 1 further including brushes on said circumferential surface of said cutting blade cylinder.

* * * * *